US006173975B1

(12) United States Patent
Brandner

(10) Patent No.: US 6,173,975 B1
(45) Date of Patent: Jan. 16, 2001

(54) V-LINE SKATE WITH EXPANDABLE AXLE

(76) Inventor: Ernest E. Brandner, General Delivery, Couderay, WI (US) 54828

( * ) Notice: Under 35 U.S.C. 154(b), the term of this patent shall be extended for 0 days.

(21) Appl. No.: 08/464,760

(22) PCT Filed: May 19, 1995

(86) PCT No.: PCT/US95/06377

§ 371 Date: Oct. 26, 1998

§ 102(e) Date: Oct. 26, 1998

(87) PCT Pub. No.: WO96/36531

PCT Pub. Date: Nov. 21, 1996

(51) Int. Cl.[7] ..... A63C 17/06

(52) U.S. Cl. ..... 280/11.22; 280/11.27; 301/5.7; 301/111

(58) Field of Search ..... 280/11.22, 11.27, 280/11.19, 11.2, 7.13, 11.23, 11.25, 11.3, 87.041; 301/5.3, 115, 117, 5.7, 35.63

(56) References Cited

U.S. PATENT DOCUMENTS 3,387,852 * 6/1968 Sarro ..... 280/11.22
4,603,868 * 8/1986 Schutz ..... 280/11.22
5,251,920 * 10/1993 McHale ..... 280/11.22
5,271,633 * 12/1993 Hill, Jr. ..... 280/11.22
5,303,940 * 4/1994 Brandner ..... 280/11.22
5,549,309 * 8/1996 Gleichmann ..... 280/11.22

FOREIGN PATENT DOCUMENTS

19680 * 8/1912 (GB) ..... 301/117
185360 * 9/1922 (GB) ..... 301/117

* cited by examiner

*Primary Examiner*—Anne Marie Boehler
(74) *Attorney, Agent, or Firm*—Julian C. Renfro, Esq.

(57) ABSTRACT

A mounting plate (20, 120) for a linear skate upon which a plurality of wheel supporting brackets (22, 24, 26 and 28) are affixed in an equally spaced, generally aligned relationship. A wheel-receiving axle (32, 34, 36 and 38) is secured in each bracket, with each axle intended to receive thereon a closely fitting skate wheel (12, 14, 16 and 18). Each axle has a novel, expansion-producing arrangement (52, 62) enabling the outer end of the axle to be enlarged so as to tightly engage the non-rotatable inner portion (80) of a respective skate wheel. Each wheel is thus retained on its respective axle in a fully operational manner, without fear of the wheel coming off the end of the axle. The mounting plate has raised shoulders (84 and 86; 126 and 128) along each long side, serving not only to prevent undesired bending or twisting, but also serving to prevent the several wheel-supporting brackets from twisting out of a desired relationship to the mounting plate.

21 Claims, 4 Drawing Sheets

28
38
10
84
26
24
20
88
18
86
16
34
22
14
12

34
32
30
88
22
84
36
24
14
20
26
86
30
28
38
18

30
20
98
102
102

99
98
84
86
88
99
30
22
32

86
100
31
21
88
14
24
25
76
40
84
34
54
64
62
37
35
66
60
42
78
24
50
52

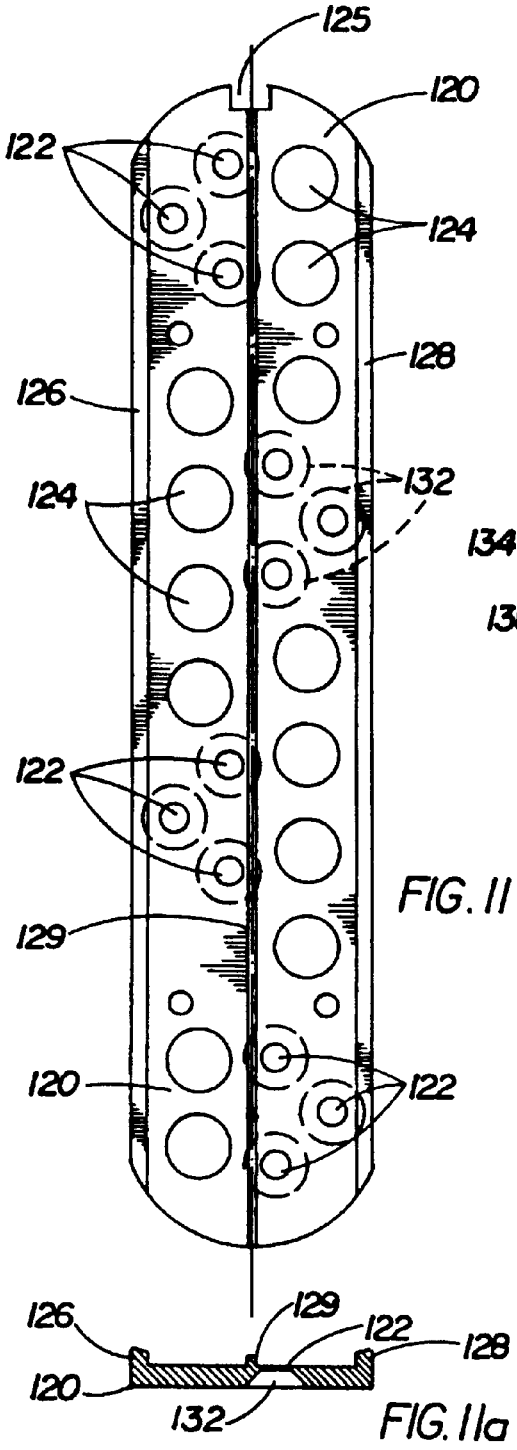
FIG. 11
FIG. 11a
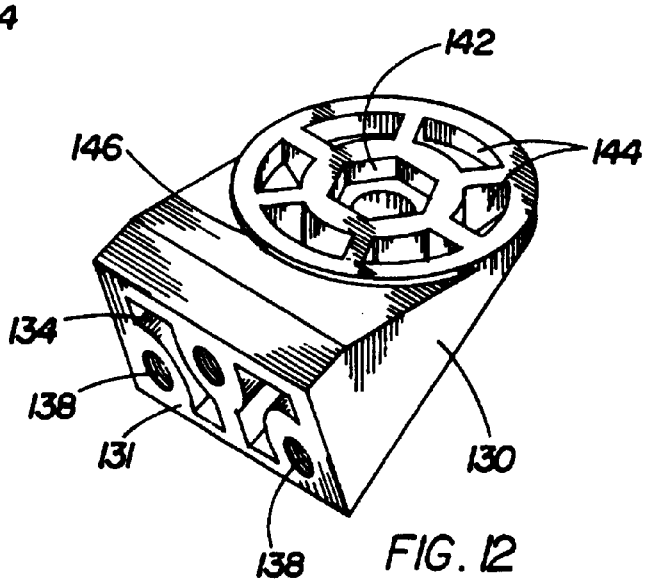
FIG. 12

V-LINE SKATE WITH EXPANDABLE AXLE

BACKGROUND OF THE INVENTION

This invention primarily relates to a certain type of in-line or linear roller skate, and more particularly to a skate having wheels disposed in an alternating angular array I call a V-line relationship. In accordance with this invention, the wheels are supported by the use of an improved axle arrangement, which axle arrangement is highly advantageous under a number of operating conditions.

Many generations of children and adults alike have enjoyed the pleasures of roller skating, and originally the roller skates they used were of the so-called "quad" type, with each skate having a pair of wheels in the front, and a pair of wheels in the back.

For reasons of increased speed and maneuverability, many skaters have stopped using quad skates, and have gone over to what are variously referred to as linear skates, in-line skates or blade skates, involving a design wherein the ground-contacting portions of the wheels of each skate are disposed along a straight line. Linear or in-line skates have at least three wheels, but may utilize four, five or possibly more wheels, for as a generality, the larger the number of wheels, the smoother the ride.

In-line or linear roller skates of conventional construction normally utilize two or more wheels positioned to rotate within a common vertical plane, and while operating as roller skates, have much of the feel and behavior associated with ice skates. Substantially the same bodily movements are required to operate both ice skates and in-line roller skates, and such roller skates have become increasingly popular with ice skaters as a desirable training tool for off season and on-street use. In recent years, in-line roller skates have been capturing an increasing share of the recreational skate market and in time may parallel or even surpass jogging as a healthy and pleasurable adult sport.

Tandem or in-line skates are well known and appear at least as early as 1876 in U.S. Pat. No. 7,345 of C. W. Saladee, which disclosed a two-wheel in-line model featuring a somewhat complex, spring loaded carriage supporting laterally pivoting rollers for improved maneuverability and even distribution of skater weight. Unfortunately, this early device was heavy, noisy and quite complicated to manufacture and assemble.

In 1946, U.S. Pat. No. 2,412,290 to O. G. Rieske disclosed a heavy metal framed, three-wheel, in-line skate for indoor use which featured an endless, rubberized belt so as to avoid damage to wooden floors. The belt rotated on three pulley-like wheels wherein the intermediate wheel was vertically adjustable to produce a rocking action in a forward or rearward direction which made it easier to steer and maneuver the skate. Vertical adjustment of the intermediate wheel was achieved by a clamping bolt and a system of interlocking teeth and allowed a range of vertical adjustment.

In 1966, G. K. Ware in U.S. Pat. No. 3,287,023 disclosed an in-line skate with thin, rounded wheels which endeavored to simulate the performance of ice skates. The Ware skate utilized a fairly heavy metal frame having front and rear frame members with longitudinally extending and overlapping sections. Three sections had a multiplicity of horizontally arranged axle apertures which permitted positioning of wheel axles in a variety of different locations and provided continuous adjustability of the frame to accommodate a wide variety of boot sizes. The Ware frame also included the positioning of apertures at several elevations at the front and rear of the skate so that the forward and rear wheels could be a higher level than the two intermediate wheels. The Ware frame and variations of it are still in use on currently available in-line roller skates and has been the best all around frame available for such skates.

U.S. Pat. No. 4,492,385 to Scott B. Olson disclosed a hybrid skate combining the desirable features of both ice and roller skates and featured a mounting system which could carry either the traditional ice skating blade or a series of in-line wheels.

The Olson et al U.S. Pat. No. 5,048,848 entitled "In-Line Roller Skate with Axle Aperture Plugs for Simplified Wheel Installation" and the Hill U.S. Pat. No. 5,271,633 entitled "In-Line Roller Skate Having Easily Replaceable Bearings" each teach a wheel supported by an axle extending between longitudinally extending members, but are entirely silent as to what may be regarded as axle construction of the cantilever type.

My U.S. Pat. No. 5,303,940 entitled "SKATE HAVING ANGULARLY MOUNTED WHEELS", which issued Apr. 19, 1994, taught the use of angularly disposed wheels mounted upon axles supported from a single location, in what may be considered to be a cantilevered arrangement. I had found that use of the wheels disposed in an angularly disposed relationship to the mounting plate as described in this earlier patent not only enabled a user of the skate to achieve improved traction during a turn, but also permitted the wheels to be spaced more closely together along the longitudinal axis of the mounting plate, thus minimizing the length of the skate in a highly desirable manner.

Although several embodiments of angularly placed wheel relationships were set forth in my U.S. Pat. No. 5,303,940, one of the most important embodiments was the one utilizing a V-line relationship in which the wheels of the skate are disposed on cantilevered axles in an alternating angular relationship. In other words, the wheels are mounted at equal angles to a plane vertical to the mounting plate, but with each succeeding wheel being disposed on the opposite side of the vertical from the preceding wheel.

As will be seen in more detail hereinafter, the present invention is particularly well adapted for use with a skate having wheels disposed in the above-mentioned V-line relationship.

In my U.S. Pat. No. 5,303,940, I utilized axles in which each wheel of the skate is held on the cantilevered axle by a nut, by a device known as a lever lock axle, or the like. Neither of these mentioned arrangements has proven to be entirely satisfactory, which has impelled me to investigate improved arrangements for holding each wheel of the skate in an operative relationship to the mounting plate of the skate.

It was in an effort to improve upon these wheel mounting arrangements of the prior art that the present invention was evolved.

SUMMARY OF THE INVENTION

A roller skate in accordance with a preferred embodiment of this invention utilizes a plurality of angularly mounted wheels disposed generally in what I call a "V-line array" along the longitudinal axis of a mounting plate attached to the sole of a boot or shoe, with the treads or ground-contacting portions of the wheels of the skate disposed in alignment. In accordance with this preferred embodiment, the wheels of my skate are mounted in a relationship in which the wheels, supported from cantilevered axles of novel construction, are disposed in an alternating angular array, with adjacent wheels disposed on opposite sides of a plane vertical to the mounting plate. I also utilize the terminology "V-line construction" to describe the left-right, left-right relationship of the skate wheels.

It is possible in accordance with another embodiment of my invention to utilize wheels disposed in a consistently angled array, with adjacent wheels disposed at an identical angle on the same side of a plane vertical to the mounting plate of the skate, but this is not a preferred embodiment of the instant invention.

A plurality of novel wheel mounting hangers or brackets are affixed in a spaced relationship along a mounting surface located on the underside of the mounting plate, with each of such hangers configured to support in a cantilevered manner, an axle upon which a wheel of the skate is rotatably mounted.

As will be seen hereinafter, the cantilevered axle I use with each of these hangers or wheel mounting brackets is of novel, highly advantageous construction.

With further regard to the installation of the wheel mounting hangers on the mounting plate in an alternating, non-vertical relationship thereto, a first of such axle-receiving hangers is secured to the mounting surface of the mounting plate, with a significant portion thereof disposed at a selected angle to the vertical. Adjacent this first hanger a second hanger is secured to the mounting plate at the same angle, but importantly, this latter angle, in the preferred embodiment, is on the opposite side of a vertical plane passing through the longitudinal centerline of the skate. Thereafter a third hanger is secured to the mounting surface of the mounting plate adjacent the second hanger, parallel to the first hanger, with this third hanger therefore being disposed at the same angle to the vertical as the first hanger. In a like manner, a fourth hanger is secured adjacent the third hanger, parallel to the second hanger.

In accordance with this embodiment of my invention, these hangers or wheel mounting brackets thus serve to support the novel cantilevered axles and therefore the wheels of the skate in an alternating angular array, with the ground-contacting or tread portions of the wheels disposed in careful alignment. My skates may utilize three, four or more wheel mounting hangers or brackets secured to the mounting plate, each supporting a novel cantilevered axle upon which a respective wheel is mounted, but in the present instance, I am revealing the use of four wheels, held in place on respective mounting hangers.

It is important to note that the alternate angular mounting of the wheel array enables the hangers to be mounted closer together along the longitudinal axis of the mounting plate than would otherwise have been possible without interference between the wheels, with the increased number of wheels and the angularity of alternate wheels enabling the user of the skate to obtain a better ride with more wheels under the foot, with little or no protrusion at the heel or toe of the skate.

The feature permitting some degree of overlap of the wheels is particularly important in the case of mounting plates used in conjunction with relatively small boots and shoes, such as shoe sizes five to nine.

As is obvious, when larger boot and shoe sized become involved, this overlap feature becomes less critical, and for the particularly large sizes, any need for wheel overlap completely disappears.

Skates utilizing alternately angled wheels are particularly important for outside use, such as for road and track. Had the wheel mounting hangers been mounted in a non-alternating array, the wheels could not be spaced as closely together as when they alternate in a left-right, left-right arrangement.

In addition to the use of the novel cantilevered axle, my invention may also involve several additional features, such as the use of a mounting plate of highly advantageous construction, wherein an elongate shoulder or strengthening member extends for the full length of each long side of the mounting plate. These shoulders are a bit thicker than the portions of the mounting plate to which the hangers are to be attached, and the shoulders not only provide effective resistance to undesired bending or torsion, but also these shoulders serve the very important function of assisting the maintenance of the wheel mounting hangers in a highly effective, properly aligned relationship. The strengthening effect of the shoulders may be supplemented by a central strengthening member, extending substantially the length of the mounting plate. As will be pointed out hereinafter, the central strengthening member also aids in maintaining the proper alignment of the wheel mounting hangers.

It is a principal object of my invention to provide a highly satisfactory, low cost arrangement for securing an essentially conventional skate wheel upon each of the cantilevered axles of a V-line skate, linear skate or the like, with this novel quick release arrangement making it possible to exchange one skate wheel for another in a minimum length of time.

It is another object of my invention to provide in a wheeled skate whose wheels are mounted in a pattern of alternating angularity, an improved, economically priced wheel mounting arrangement that enables the user to install an in-line skate wheel equipped with a pair of precision bearings in a highly effective, entirely safe manner upon the axles of each of the wheel mounting hangers of the skate, with such installation of a wheel, or the subsequent removal of the wheel, being accomplished in a minimum length of time.

It is still another object of this invention to provide a novel, highly effective axle locking arrangement for a cantilevered axle, in which a novel tightening arrangement enables the diameter of the outer end of the axle to be selectively enlarged to prevent the respective wheel from coming off, thus making it possible for a wheel to be quickly released from the skate and moved to another location on the skate or else immediately replaced with another wheel, without the need for the use of anything other than a very simple tool.

It is yet still another object of my invention to utilize a highly advantageous axle expansion arrangement for holding the inner race of the outer wheel bearing tightly in place, much more tightly than when the inner races of the wheel bearings are secured on a skate axle in a conventional, longitudinally clamped manner, with my novel axle expansion arrangement effectively eliminating any tendency toward looseness of the bearings on the axle, and thus causing the skate wheels to roll in a substantially improved manner.

It is yet still another object of this invention to provide a novel mounting plate for the wheels of a linear skate, featuring a combination of lightness with considerable rigidity, and utilizing highly effective means for preventing any twisting of the axle supporting hangers utilized on the mounting plate.

It is yet still another object of this invention to provide a novel combination of axle supporting hangers with the mounting plate of a linear skate, with special means being utilized for preventing any undesirable twisting of the hangers, thus to assure the wheels of the skate remaining in careful alignment.

These and other objects, features and advantages of this invention will be apparent from a study of the appended drawings and text.

BRIEF DESCRIPTION OF DRAWINGS

FIG. 11 is a view of the underside of another embodiment of my novel mounting plate, revealing the utilization of lightening holes that are circular rather than oblong;

FIG. 11*a* is an end view of the mounting plate embodiment of FIG. 11; and FIG. 12 is a perspective view, revealing additional details of a particularly satisfactory hanger or wheel mounting bracket serving to support one of my novel expandable axles.

DETAILED DESCRIPTION

Figure 1:
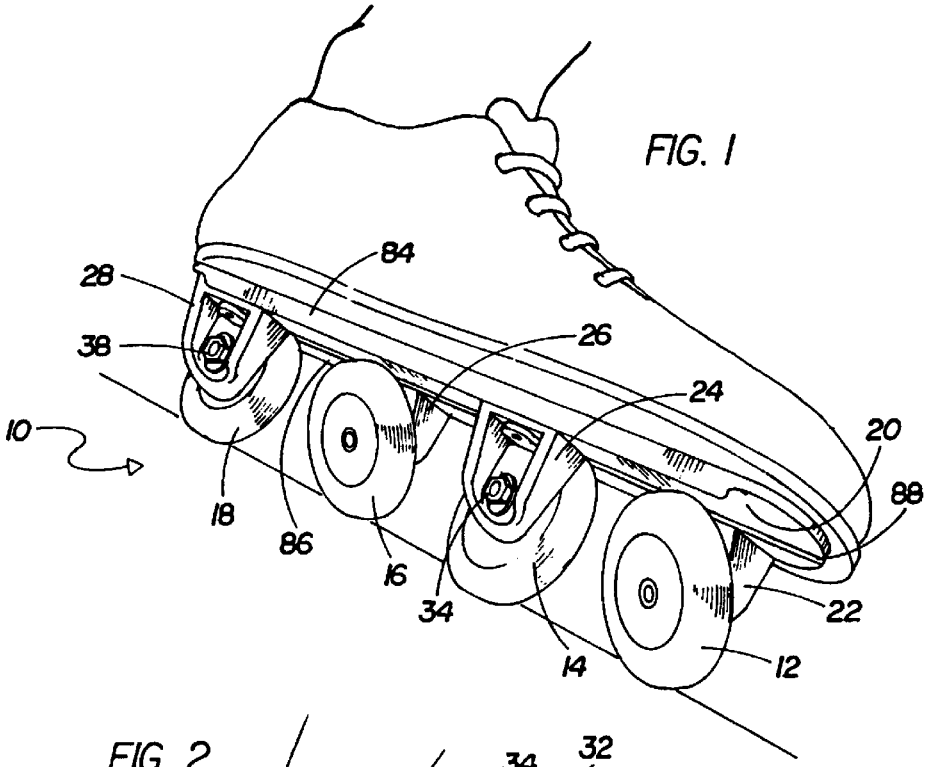
FIG. 1 is a perspective view of my novel improved linear skate, shown in an operative relationship to a boot or shoe, with the skater's right foot being illustrated in this instance.
Figure 9:
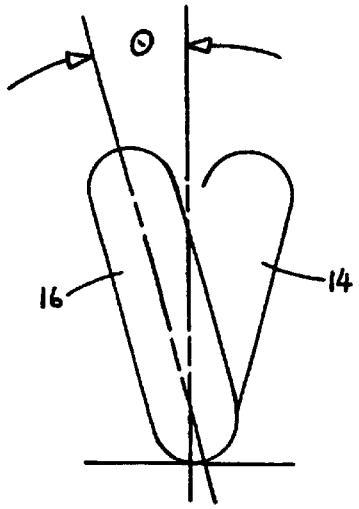
FIG. 9 is a view revealing the V-relationship I prefer to exist between the alternating wheels of my novel skate, with this view representing the typical angle each wheel makes to a vertical plane passing through the mounting plate of the skate.

With initial reference to FIG. 1 it will there be seen that I have shown a preferred embodiment of a roller skate 10 of the type variously known as a linear skate, in-line skate or blade skate, in which an improved axle arrangement in accordance with this invention is utilized. As will be discussed hereinafter, the wheels of my skate are disposed generally in an in-line relationship and preferably mounted in an angularly disposed array. I prefer to call this a V-relationship or "V-line" relationship, with this being illustrated in FIG. 9. It will be noted that each wheel is mounted on a respective axle of cantilevered type that is in turn affixed to a wheel mounting hanger attached to the mounting surface of a novel mounting plate.

Figure 3:
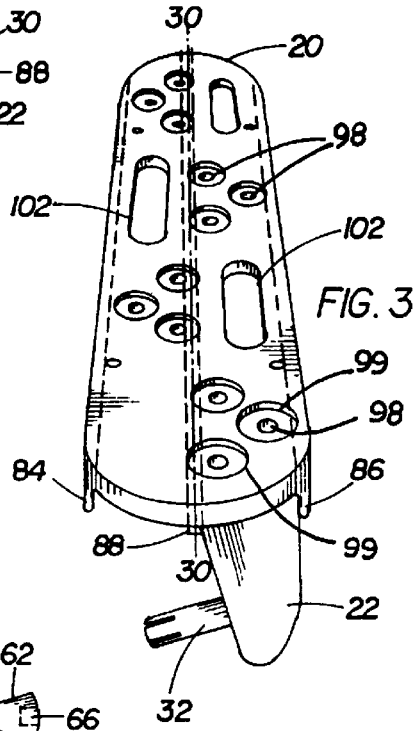
FIG. 3 is still another perspective view, this involving an illustration of the upper surface of one embodiment of the novel mounting plate upon which the wheel mounting hangers are removably secured, with the front of this mounting plate being in the foreground in this instance, and it being understood that the left mounting plate is a mirror image of the right mounting plate.

More specifically, FIG. 1 reveals that the skate 10 utilizes angularly mounted wheels 12, 14, 16 and 18 disposed with their treads or ground-contacting surfaces in an in-line relationship. Although shown to a certain extent in FIG. 1, the particular wheel mounting plate 20 upon which these wheels are operatively mounted is best seen in FIG. 3. It is upon the wheel mounting plate 20 that the base portions 31 of the respective wheel supporting hangers 22, 24, 26 and 28 are affixed in an essentially consistently spaced relationship along the mounting surface 21 located on the underside of the mounting plate 20. I may also call the members 22, 24, 26 and 28 wheel supporting brackets or axle supporting brackets, and it is to be understood that these members are disposed in a symmetrical, alternating relationship along the longitudinal centerline 30—30 of the mounting plate.

Figure 2:
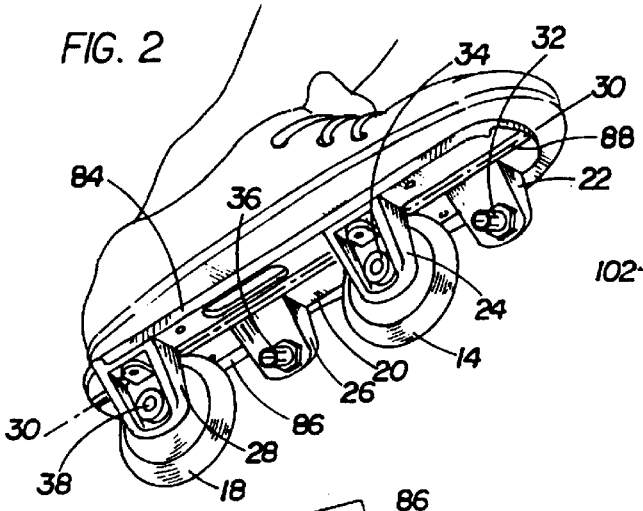
FIG. 2 is another perspective view of the same skate as depicted in FIG. 1, with two of the wheels removed, and the mounting plate of the skate oriented so as to reveal certain of the significant wheel mounting relationships utilized in accordance with this invention.

In FIG. 2 the mounting plate 20 has been oriented so as to reveal the mounting surface 21 and other underside portions of my novel skate, with two of the wheels being removed in order to reveal some details of the novel axle construction I utilize in accordance with this invention. In FIG. 2 it is made clear that the axle 32 is mounted in a cantilever manner in hanger 22. In a similar manner, axle 34 is mounted in hanger 24; axle 36 is mounted in hanger 26; and axle 38 is mounted in hanger 28.

It is important to realize that a first end of each axle has threaded attachment means enabling the axle to be secured in a mounting hole provided in the respective hanger, as will shortly be discussed in some detail.

Figure 4:
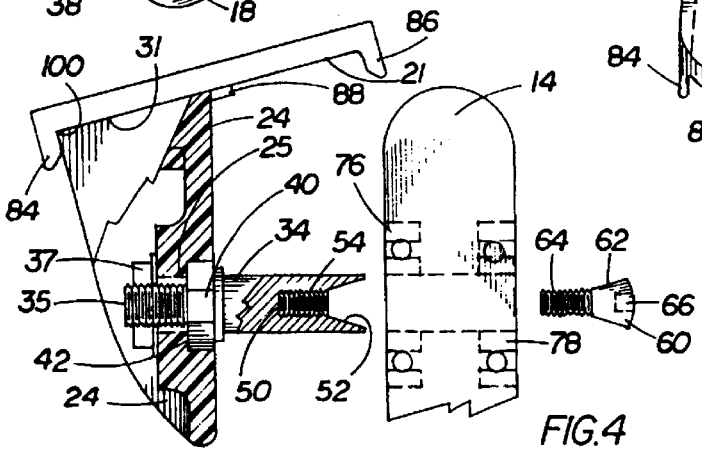
FIG. 4 is a view to a larger scale of an exemplary expanding axle arrangement forming one of the important aspects of my invention, with a portion of the axle cut away to reveal a longitudinally extending hole having a relatively shallow, tapered outer hole portion, and a threaded, relatively deep inner portion, with it to be understood that a tightening screw is utilized for axle expanding reasons in conjunction with the longitudinally extending hole in the axle.

Inasmuch as all of the hangers, axles, wheels and other components of this novel skate are substantially identical to each other, I have arbitrarily selected axle 34 as an exemplary axle, which is depicted in enlarged detail in FIG. 4.

FIG. 4 is intended to make clear the fact that a mounting hole is provided in each of the substantially identical wheel supporting hangers, with the mounting hole disposed at an angle to the base portion 31 of the hanger. Inasmuch as wheel supporting hanger 24 has arbitrarily been illustrated in this instance, it is to be understood that axle mounting hole 25 is provided in the hanger 24. A novel wheel-receiving axle 34 in accordance with this invention is rigidly mounted in the mounting hole 25 located in the hanger 24. What may be regarded as the first end of the exemplary axle 34 of my skate is provided with external threads, upon which a suitable nut 37 is to be operatively received. Because the first end of the axle 34 is provided with external threads 35 for receiving the nut 37, upon the nut being sufficiently tightened upon these threads, this will prevent the axle 34 from becoming loosened from a proper wheel-supporting relationship with the hanger 24.

With continued reference to FIG. 4, in order that the axle will be mounted in a non-rotational manner in the hanger 24, I prefer to utilize a hexagonally shaped member 40 on the axle 34, at a location relatively close to the previously mentioned threads 35. A hexagonally shaped aperture 42 of a size slightly larger than the member 40 is provided in the hanger 24 in alignment with the hole 25 extending through the hanger, with the aperture 42 being located on the side of the hanger opposite the nut 37. Thereafter, when the nut 37 (with accompanying washer) is applied to the threads 35 of the axle 34 and then tightened, the nut will bear against the sidewall of the hole 25 on the side of the hanger opposite the hex shaped aperture 42, and secure the axle in the hanger 24. As is obvious, undesirable rotation of the axle 34 is prevented because of the relationship of the hex shaped member 40 to the hex shaped aperture 42.

Inasmuch as a principal feature of my invention involves a novel means for holding the skate wheels in a operative relationship on the respective axles, it is to be understood that the axles 32, 34, 36 and 38 are each of a size such that a wheel bearing assembly may be closely fitted thereon. I regard a wheel bearing assembly as a precision bearing pressed into the hub aperture on each side of each skate wheel.

It is most important to understand that the second or outer end of each of axles 32, 34, 36 and 38 has novel expansion-producing means therein, with this means including a tightenable member which, when tightened, will enlarge the diameter of the outer or second end of the respective axle such that the non-rotational inner portion of the respective wheel will be forcefully encountered, thus to maintain the wheel in an operational position on the axle. This effectively serves to retain the closely fitting skate wheel bearing assembly in what may be regarded as a mid portion of the respective axle, reliably preventing the wheel from coming off the end of its axle.

It is to be noted that the height of the hanger or wheel mounting bracket I prefer to utilize is able to accept wheels of 71.5 mm outer diameter, but obviously I am not to be limited to this. As another example, I can utilize hangers or brackets accepting wheels up to 80 mm in diameter.

The expansion-producing means I utilize in accordance with this invention involves the second end of each of the axles 32, 34, 36 and 38 having a hole extending along the centerline of the axle, and with reference to FIG. 4, it will be seen that exemplary axle 34 is provided with a longitudinally extending hole 50. The hole 50 is constituted by a relatively shallow outer hole portion 52, which is directly connected to a relatively deep inner hole portion 54, with both hole portions residing in alignment with the longitudinal centerline of the axle. Importantly, the outer hole portion 52 of the hole 50 is tapered in a generally conical manner, and the inner hole portion 54 of the hole is threaded. The tightenable member I utilize in conjunction with this arrangement is a screw 60 having a tapered head 62, with this tapered head being of a configuration generally matching the taper of the tapered outer hole portion 52. The end of the screw 60 opposite the conically tapered head has threads 64 thereon, adapted to enter the end of the axle and operatively engage the threads of the threaded inner hole portion 54. It will be noted from FIG. 4 as well as FIG. 5 that a suitable socket or recess 66 is provided in the head of the screw 60 for receiving the end of an alien wrench in an operational manner. Therefore, by the use of the allen wrench, the user can readily remove a wheel or, alternatively, securely tighten a wheel bearing assembly in the operative position on its respective axle. Each screw 60 utilized in accordance with my novel skate is preferably of the general construction illustrated in FIGS. 4 and 5.

Figure 5:
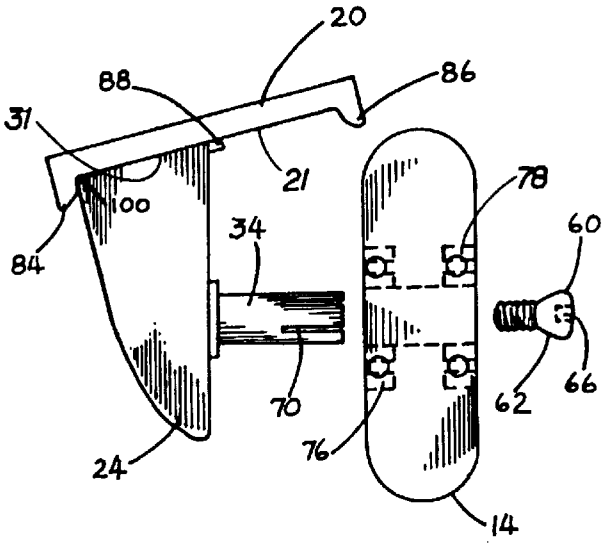
FIG. 5 is a view generally along the lines of FIG. 4, but to a smaller scale and illustrating the plurality of longitudinally extending slots I utilize in the outer part of each axle in order to permit a desirable amount of axle expansion upon the tightening of the screw utilized in the hole extending along the centerline of the axle.

It is significant to note, as illustrated on the exemplary axle depicted in FIG. 5, that the second or outer end of each axle, wherein the longitudinally disposed hole 50 is contained, is provided with longitudinal slots 70 therein. The longitudinal slots 70 extend for approximately one-half the length of the wheel-receiving mid portion of the axle, with these slots serving the important function of permitting the tapered head 62 of each screw 60, when the screw is firmly tightened, to cause the end of the respective shaft to enlarge. As should now be clear, this tightening of the screw causes the second or outer end of the axle to be forced into a very tightly fitting relationship with the non-rotatable inner portion of the respective wheel bearing, which in most instances is the inner race of the outer bearing utilized on the skate wheel. In this manner the respective closely fitting skate wheel, wheel 14 in the illustrated embodiment, is prevented in a very effective manner from coming off the end of the axle when wheel removal is not intended.

Figure 7:
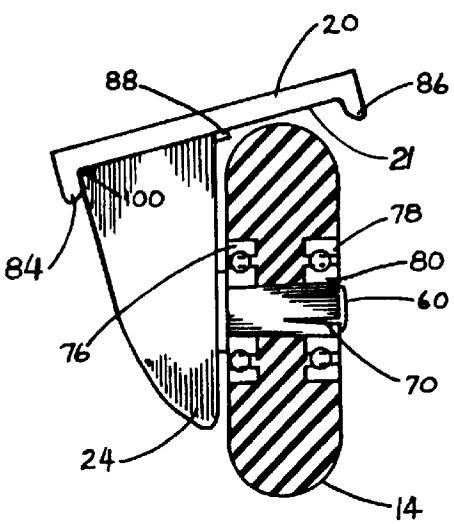
FIG. 7 is a view in which the skate wheel has been sectioned so as to reveal in a somewhat exaggerated manner, the fact that the outer end of the expandable axle bears outwardly against the non-rotatable inner portion of the outer bearing of the wheel with sufficient outward force as to prevent the wheel coming off the end of the axle.
Figure 6:
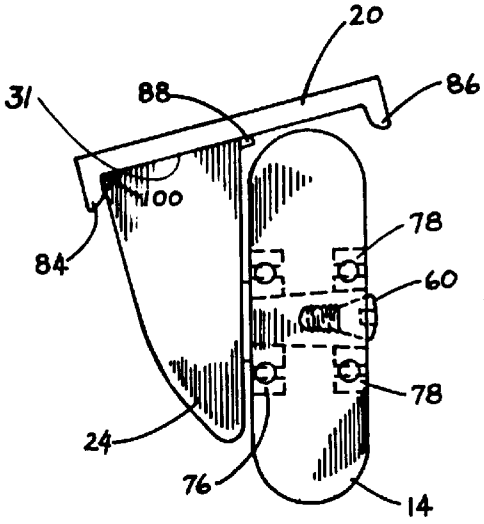
FIG. 6 is a figure resembling FIG. 5 but with a skate wheel mounted upon the exemplary axle.

With reference to FIG. 7, it will be noted that I have shown in cutaway form, the manner in which the conventional skate wheel 14 is mounted in close fitting relationship on the exemplary, cantilevered axle 34. Because of this close fitting relationship, the outward expansion of the end of the axle 34 causes the end of the axle to bear tightly against the non-rotating hub portion of the wheel bearing 14. To minimize friction and to obtain satisfactory performance, the conventional skate wheel 14, such as of urethane, is equipped with inner and outer ball bearings 76 and 78, with the outer bearing 78 having a non-rotating inner race or hub portion 80 against which the axle expands outwardly in a forceful manner when the tightenable means, the screw 60, is tightened in order to accomplish wheel bearing retention. The bearings I use may be ABEC 3 bearings, although I obviously am not to be limited to bearings of this designation.

As is obvious, the hub portion 80 of the wheel is of relatively sturdy construction, so that when the screw 60 serving as the tightenable member has been tightened to cause the outer end of the respective axle to expand in forceful contact with the hub portion, this does not prevent the wheel bearing assembly from continuing to rotate freely in the intended manner. As a matter of fact, the highly advantageous axle expansion arrangement I utilize for holding the inner race of the outer wheel bearing tightly in place serves by its outward expansion to hold the respective wheel in its operational position much more tightly than is the case when the inner races of the wheel bearings of each wheel are secured on a conventional skate axle in a conventional, longitudinally clamped manner. This is because my novel axle expansion arrangement effectively eliminates any tendency toward looseness of the bearings on the axle, and thus causing the skate wheels to roll in a substantially improved manner.

Because my novel axles, typically four in number, are mounted in what may be regarded as a cantilever relationship upon the respective wheel mounting hangers, it is important that the hangers be prevented from twisting out of a properly aligned relationship. Should one or more of the wheel mounting hangers undergo a certain amount of twist or misalignment, this will prevent the tread portions of the several wheels being in the desirable aligned relationship mentioned in the description of FIG. 1.

Although the wheel mounting hangers could be made of any of several different materials, I prefer to make the brackets of plastic that involves glass filled nylon.

It is appropriate at this point to turn to another significant aspect of my invention, which involves the novel mounting plate 20 provided with means for preventing the wheel supporting hangers from moving away from a relationship in which all of the axles, when viewed from above, are in a properly aligned, parallel relationship. This latter statement is not to be confused with the fact that in the embodiment illustrated in FIG. 2, the axles 32 and 36 are at one angularity with respect to a center plane passing through the centerline 30—30 of the skate mounting plate, and the axles 34 and 38 are at a different angularity with respect to the center plane passing through the centerline of the skate. This is to say, however, that all of the axles, when viewed from either above the skate or below the skate, are in a parallel relationship, assuring that all of the wheels will be disposed with their tread portions able to roll along a common line. Obviously if one axle is twisted away from a desirable relationship with the other axles, this would greatly impede the efforts of the skater to skate in a proper manner.

Figure 10:
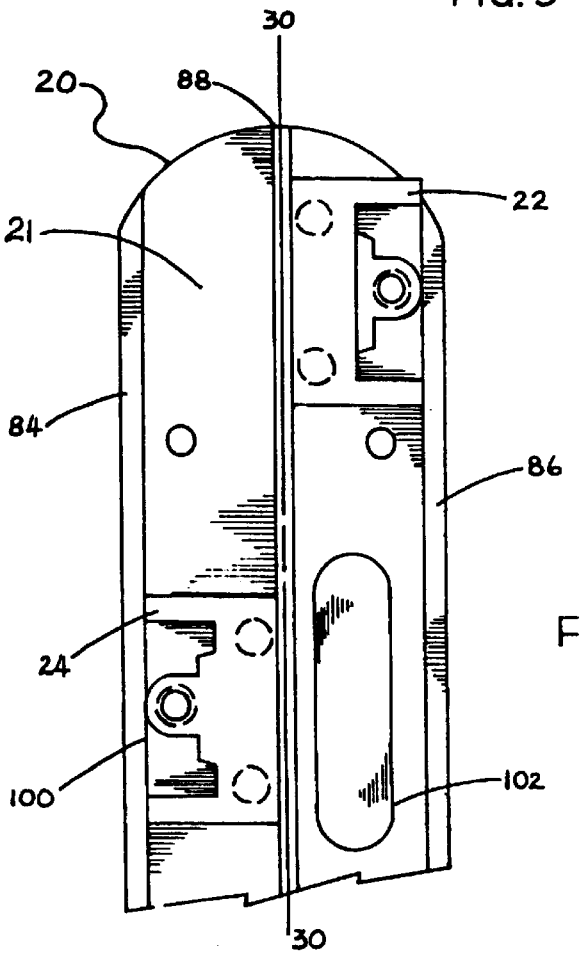
FIG. 10 is a view, to a larger scale, of a portion of the underside of the mounting plate embodiment depicted in FIG. 3, showing further details of the manner in which each wheel mounting hanger resides on the mounting surface, disposed tightly between an outer shoulder and the center reinforcement member of the mounting plate.

With regard to the novel mounting plate 20 illustrated in FIGS. 2, 3 and 10, it is to be noted that I prefer to utilize longitudinally extending shoulders 84 and 86 that are disposed along the outer edges of the mounting plate 20. These shoulders reside on the underside of the mounting plate, adjacent each mounting surface 21, and because they are somewhat thicker than the portions of the mounting plate containing the mounting surfaces 21, they provide a substantial amount of strengthening to the mounting plate 20. It is most important to note that in addition to causing the mounting plate to resist bending as well as torsional effects, the shoulders 84 and 86 serve as highly effective means for preventing any twisting of the axle supporting hangers 22, 24, 26 and 28 during the use of the skate, which would place the wheels out of a desirable alignment.

In FIGS. 4 through 8 and 10 it is to be noted that the upper edge of the hanger 24 tightly abuts the shoulder 84 along edge 100.

In addition to the shoulders 84 and 86, I prefer to also use a center reinforcement member or central strengthening member 88 extending substantially the entire length of the underside of the mounting plate 20 in a parallel relationship to the shoulders, with the member 88 residing on the longitudinal centerline 30—30. Each wheel supporting hanger fits tightly on a mounting surface 21 disposed between the center reinforcement member 88 and one or the other of the shoulders 84 or 86, thus assuring a no-twist mounting of the wheel supporting hangers on the underside of the mounting plate.

It will be noted from the upper surface of the mounting plate 20 depicted in FIG. 3 that three screws 90 are utilized in conjunction with each wheel mounting hanger, for securing each hanger in the appropriate location on the underside of the mounting plate 20. In the embodiment illustrated in FIG. 3, four sets of three screws are utilized, with each of the screws residing in a countersunk portion 99 in order that the heads of the screws utilized for engaging the base portions 31 of the respective hangers will not protrude in such a manner as to possibly come into contact with the sole of the boot or shoe.

Figure 8:
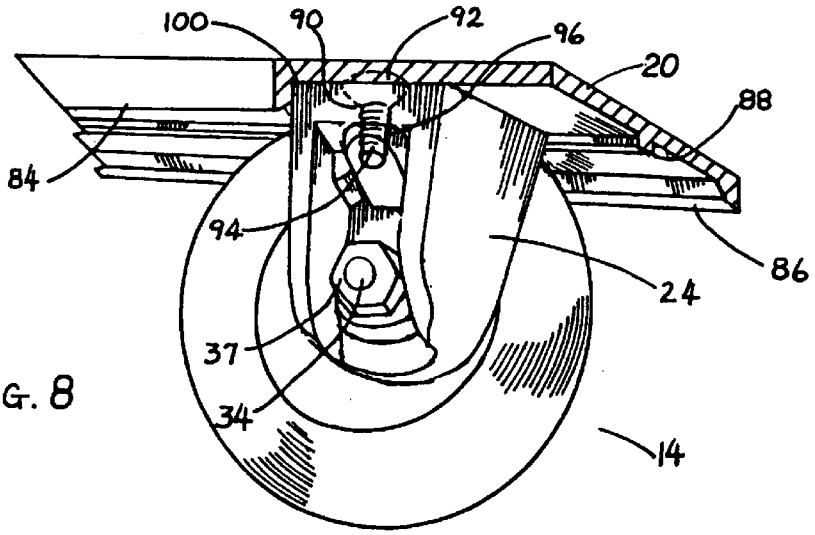
FIG. 8 is an enlarged perspective view illustrating the relationship of a wheel mounting hanger to the adjacent shoulder provided along the outer edge of the mounting plate, while at the same time contacting the center reinforcement member, with this figure also showing a typical means for securing the wheel mounting hanger to the mounting surface of the mounting plate.

With reference to FIG. 8, it is made clear in this figure that each screw 90 enters its respective hole from the upper surface of the mounting plate 20, with the generally conically shaped undersurface of each screw head residing in the respective countersunk portion 99 surrounding each hole in the mounting plate. The upper surface of the head of each screw 90 is provided with a recess or socket 98 in which the end of alien wrench can be received. Opposite the head portion 92 of each screw is the threaded portion 94, which in each instance is operatively received in a threaded hole 96 located in the upper portion of the respective hanger, referred to as the base portion 31 of the hanger. It is clear from FIGS. 3 and 8 how each set of three screws 90 hold the respective hanger in a secure relationship to the mounting surface 21 of the mounting plate 20.

Although the tightening of the three screws into each wheel mounting hanger serves to tightly hold each hanger in a rigid relationship to the mounting plate, because of the interaction of an upper edge of each wheel mounting hanger with the center reinforcement member 88 as well as with one or the other of the longitudinally extending shoulders 84 or 86, any twisting of a wheel mounting hanger is made highly unlikely.

In the interests of making the skate as light as reasonably possible, I prefer in the embodiment of the mounting plate illustrated in FIGS. 2, 3 and 10 to utilize two or more lightening holes 102, which are of oblong configuration, extending along part of the length of the mounting plate. This use of oblong mounting holes is particularly suitable for mounting plates used with 5 to 9 boot sizes, but as will be seen hereinafter, it is desirable to use lightening holes of circular configuration with larger mounting plates. As made clear in FIGS. 3 and 10, when lightening holes of oblong configuration are used, no lightening hole or slot 102 is utilized near the front end of the mounting plate inasmuch as I have found that the front wheel of the skate usually receives the most stress.

With reference now to FIG. 11, it is to be seen that I have shown a mounting plate 120 of a type I prefer to use with larger boot sizes, and in this mounting plate it will be noted that I use a series of holes 122 that are utilized in groups of three in conjunction with securing of hangers or wheel mounting brackets to the mounting plate. Mounting plate 120 also utilizes a number of relatively small lightening holes 124, which are of circular configuration. It is to be noted that these lightening holes 124 are grouped or placed so as not to consequentially reduce the desired rigidity or the resistance to twisting of the mounting plate when the skate is in use, nor to reduce the strength of the mounting plate 120 at the locations where the hangers or axle mounting brackets are to be installed.

The shoulders 126 and 128 serve in the manner previously described with respect to shoulders 84 and 86 to provide a desirable amount of torsion resistance as well as resistance to bending of the mounting plate 120.

With continued reference to FIG. 11 as well as with reference to FIG. 11*a*, it will be seen that I utilize a center reinforcement member or central strengthening member 129, which is parallel to the shoulders 126 and 128. The central member 129 serves the additional purpose of assisting the shoulders 126 and 128 in maintaining the axle-receiving hangers or wheel mounting brackets in a properly aligned relationship, such that the several axles supported by the hangers or wheel mounting brackets cannot move away from a parallel relationship as viewed from above the skate. Also revealed in FIG. 11 is a notch 125 designed to permit the addition of a heel brake to the skate if such be desired.

FIG. 12 reveals a typical hanger or axle mounting bracket 130 of a type preferred for use with the mounting plate 120, which hanger or bracket may be created by a molding technique. It will be noted in the base portion 131 of the exemplary hanger 130 that I have utilized three threaded holes 138 that have been threaded to enable the hanger to be secured to the mounting plate by the appropriate mounting screws. The mounting holes 138 are so spaced as to line up with any one of the several groups of three closely spaced holes 122 revealed in FIG. 11 to exist in the mounting plate 120. FIG. 11*a* makes clear that the holes 122 have countersunk upper portions 132 so that the heads of the screws utilized for securing the several brackets or hangers 130 to the mounting plate 120 will not protrude and interfere with the proper securing of the mounting plate to the boot or shoe. Inasmuch as the undersurface of the mounting plate is illustrated in FIG. 11, the countersunk portions 132 are revealed in this latter figure by the use of dashed lines.

With continued reference to the base portion 131 of the exemplary hanger 130, it will be noted that I have provided lightening holes 134 placed in such a manner as not to reduce the strength of the hanger to any consequential extent.

Further to be noted in FIG. 12 is a hex-shaped aperture 142 of the type previously described in conjunction with FIG. 4, for receiving the hex-shaped member or portion 40 provided on the inner end of each axle, such that the axle, when affixed to the respective hanger 130, will not rotate in use.

Surrounding the hex-shaped aperture 142 are several circumferentially provided apertures or holes 144, which not only serve a weight reduction function, but also permit a uniform consistency and thickness of the sidewall portions of the hanger when it is created by molding. Also to be noted in FIG. 12 is the radius clearance 146 provided to compensate for a possible wheel flaw of the type involved when the wheel hub separates from the urethane portion of the wheel.

It should now be apparent that by the use of my novel quick release arrangement made possible by the use of my highly advantageous expandable axles, it is readily possible for a skater to rapidly replace one wheel of the skate should it become defective, or to replace all of the wheels of the skate in the event that the surface conditions change. One example of this latter would be if the skater is moving from an out-of-doors locations to a skating rink, or vice versa.

Because of the highly advantageous axle arrangement taught herein, the skater need carry no tool or implement other than a relatively small allen wrench in order to be able to rapidly accomplish wheel replacement. It is to be noted that it is often desirable, instead of replacing the wheels, to exchange the positions of the wheels currently in use so as to accomplish an equalization of wear. This equalization of wear is not only with regard to the wheel treads or surfaces, but also with regard to an equalization of wear of the wheel bearings. Because of the rapidity by which a wheel can be removed in accordance with the teachings of my quick release axle arrangement, it is likely that a user, from time to time, will want to turn a wheel over so that it will wear on the opposite edge. Such a relocation of the skate wheels for equalization of wear reasons is much more likely to take place as a result of my quick release axle, than would have been the case if the skater found it necessary to go through a difficult wheel removal and re-installation procedure, as is necessary in accordance with the teachings of the prior art.

Because my quick release axles make it rapidly possible for a skater to remove the wheels of his or her skates, it is also much more likely, because of this novel arrangement, that the skater will frequently apply the proper lubricant to the wheel bearings of the skate and thus extend the useful life of the wheel bearings.

Although this invention has been revealed in conjunction with axles disposed at an angle to a vertical plane passing through the longitudinal centerline of the skate, it is to be understood that either my novel axle or my novel mounting plate can be used with linear skates in which the wheels are not disposed in an angular relationship with respect to a vertical plane passing through the longitudinal centerline of the mounting plate.

Although I am not to be limited to any particular constructional details, the mounting plate 120 is typically an extrusion of 6061 T-6 aluminum, with the base being 0.200" thick. I have found that if the mounting plate is 10 ¾" long, there will be a space between axles of 2.750", whereas a mounting plate 11" long involves a space between axles of 2.830"; a plate 11 ½" long involves a space between axles of 3.000"; a plate 12" long involves a space between axles of 3.166"; and a plate 12 ½" long involves a space between axles of 3.333".

Although I am not to be so limited, I prefer to utilize rivets for securing the mounting plate to the sole of the boot or shoe.

The axles I prefer to use with my novel mounting plates is of cold rolled steel, with the overall length being approximately 1.700", with the portion of the axle intended to receive the wheel being 0.950" long.

With regard to the outer hole portion 52 in each axle, this preferably involves a cone angle of 30°, with the threaded portion 54 of the axle containing, for example, 10–32 threads extending to a depth of ¾". In the event 10–32 threads are used in the threaded portion 54, the screw 60 to be used therewith is equipped with 10–32 threads, with the taper of the head corresponding to the taper of the hole 52.

In a preferred embodiment, the wheel axles have an outer diameter of $$.3125^{+.0000}_{-.0010}$$

whereas the inner diameter of the bearings used on such axle is 8 mm, which of course corresponds to 0.31496". This particular axle-bearing relationship assures a desirably close fit of the wheel on the axle without it being necessary to painstakingly select a certain wheel bearing to be installed upon a given axle.

In accordance with the above-mentioned axle embodiment, the clearance between the axle and bearing is on the order of 0.00246", so it is of interest to establish the extent of linear movement of the screw 60 into the axle 34 that is necessary in order to cause sufficient expansion of the end of the axle as to lock the outer wheel bearing firmly onto the axle.

For a screw having 32 threads to the inch, one rotation of the screw will cause the screw to move 1/32" (0.0312") into the axle, so if the tapered head portion 62 of the screw 60 is initially in tight contact with the tapered outer hole portion 52 of the axle, rotation of the screw will cause a rather substantial expansion of the end of the axle. However, because of the relatively small initial clearance between the axle and the non-rotative inner portion of the wheel bearing, substantially less than a full revolution of the screw is necessary in order to lock the wheel firmly onto the axle.

I have established that for a 10–32 screw having a head forming what may be regarded as a 30° cone, for every 0.001" of forward movement of the screw, the axle diameter will expand approximately 0.00054".

A 30° cone may be regarded as representing two 15° triangles, and the tangent of 15° being 0.2680, twice this amount is 0.5360.

Dividing the previously mentioned clearance between wheel and axle of 0.00246" by 0.5360 provides a quotient of 0.00459", which is the amount of movement of the screw into the axle in order to bring the end of the axle into firm contact with the interior portion of the outer bearing.

Inasmuch as one revolution of the 10–32 screw involves a movement of 0.0312", dividing 0.00459 by 0.0312 provides a quotient of 0.1471, this latter figure representing a percentage of a full 360° rotation, which is approximately 53° degrees.

It is therefore to be seen that a rotation of approximately 53° of the screw 60 is involved in order to achieve a satisfactory locking of the wheel upon the axle.

As is obvious, I am not to be limited to the foregoing dimensions, calculations or materials, except as required by the scope of the appended claims.

I claim:

1. A roller skate having wheels disposed generally in an in-line relationship, said skate comprising a mounting plate adapted to be secured to the sole of a boot or shoe, with said mounting plate having a mounting surface receiving thereon a plurality of wheel supporting hangers, each hanger having a base portion to be affixed to said mounting surface and also having an axle-receiving mounting hole therein, a wheel-receiving axle having first and second ends operatively associated with each hanger, with each said axle having a portion, intermediate said first and second ends, for receiving thereon a closely fitting skate wheel utilizing first and second ball bearings, said first end of each axle to be secured in the mounting hole of the respective hanger, said second end of each axle having expansion-producing means, the first of said ball bearings being located closely adjacent said hanger and the second bearing being located outboard of said first bearing, each ball bearing having an inner race and an outer race, said expansion producing means including a tightenable member which, when tightened, will enlarge the diameter of said second end of the axle into forceful contact with the inner race of the second bearing of a wheel placed on the axle, thus preventing rotation of the inner bearing race while not restraining rotation of the outer race, the use of said tightenable member effectively preventing the wheel from coming off the end of the axle.

2. The roller skate utilizing wheels disposed generally in an in-line relationship as recited in claim 1 in which said expansion-producing means involves a threaded hole disposed on the longitudinal centerline of each axle, a screw having threads thereon, adapted to enter the end of the axle and operatively engage the threads of said threaded hole, said second end of each axle having longitudinal slots therein, permitting the screw, when tightened, to cause the end of the respective shaft to enlarge.

3. The roller skate utilizing wheels disposed generally in an in-line relationship as recited in claim 1 in which each of said wheel supporting hangers has a mounting hole disposed at an angle to its base portion, so that the respective axle will be received therein at an angle to the mounting plate to which the hanger is affixed, the axle of each hanger residing at an angle to the base plate as a consequence of the angularly disposed hole, resulting in a wheel mounted on the axle being disposed at an angle to the mounting plate.

4. The roller skate utilizing wheels disposed generally in an in-line relationship as recited in claim 3 in which said wheel supporting hangers are mounted on said mounting plate in an alternating array, with the axle operatively associated with one hanger being disposed at an angle with respect to the axle secured to the adjacent hanger, thus causing the wheels mounted on said axles to be disposed in a V-relationship, with the treads of such wheels being disposed in alignment.

5. The roller skate utilizing wheels disposed generally in an in-line relationship as recited in claim 1 in which said mounting plate is of elongate construction, having a pair of long sides, with a shoulder extending along each of said long sides, which shoulders are adjacent the mounting surface of said mounting plate and said wheel supporting hangers, the base portion of each of said hangers being secured in close contact with a respective shoulder, thus to prevent any undesired twisting of a supporting hanger when the skate is in use.

6. The roller skate utilizing wheels disposed generally in an in-line relationship as recited in claim 5 in which a strengthening member is utilized along the centerline of the mounting surface of said mounting plate, with each of said hangers also being in close contact with said strengthening member.

7. A roller skate utilizing wheels disposed generally in an in-line relationship, said skate comprising a mounting plate having a mounting surface upon which a plurality of wheel supporting hangers are affixed in an essentially equally spaced relationship, a mounting hole in each of said wheel supporting hangers, a wheel-receiving axle having first and second ends, with an axle to be installed in the mounting hole in the respective hanger, a first end of each axle having attachment means enabling the axle to be securely mounted in the mounting hole in the respective hanger, a mid portion of each axle configured for receiving a closely fitting skate wheel thereon, said second end of each axle having expansion-producing means therein, the skate wheel received on each axle utilizing at least one ball bearing having inner and outer races, said expansion-producing means including a tightenable member which, when tightened, will enlarge the diameter of said second end of the axle, thus forcing said second end of the respective axle into a very tightly fitted relationship with the inner race of the bearing utilized in the wheel closely fitted on the axle, thus to prevent rotation of said inner race and preventing the wheel from coming off the end of the axle.

8. The roller skate utilizing wheels disposed generally in an in-line relationship as recited in claim 7 in which said expansion-producing means involves a threaded hole disposed on the longitudinal centerline of each axle, a screw having threads thereon, adapted to enter the end of the axle and operatively engage the threads of said threaded hole, said second end of each axle having longitudinal slots therein, permitting the screw, when tightened, to cause the end of the respective shaft to enlarge.

9. The roller skate utilizing wheels disposed generally in an in-line relationship as recited in claim 7 in which each of said wheel supporting hangers has a mounting hole disposed at an angle, so that the respective axle will be received therein at an angle to the mounting plate to which the hanger is affixed, the axle of each hanger residing at an angle to the base plate as a consequence of the angularly disposed hole, resulting in a wheel mounted on the axle being disposed at an angle to the mounting plate.

10. The roller skate utilizing wheels disposed generally in an in-line relationship as recited in claim 9 in which said wheel supporting hangers are mounted on said mounting plate in an alternating array, with the axle operatively associated with one hanger being disposed at an angle with respect to the axle secured to the adjacent hanger, thus causing the wheels mounted on said axles to be disposed in a V-relationship, with the treads of such wheels being disposed in alignment.

11. The roller skate utilizing wheels disposed generally in an in-line relationship as recited in claim 7 in which said mounting plate is of elongate construction, having a pair of long sides, with a shoulder extending along each of said long sides, which shoulders are adjacent the mounting surface of said mounting plate and said wheel supporting hangers, the base portion of each of said hangers being secured in close contact with a respective shoulder, thus to prevent any undesired twisting of a supporting hanger when the skate is in use.

12. The roller skate utilizing wheels disposed generally in an in-line relationship as recited in claim 11 in which a reinforcing member is utilized along the centerline of the mounting surface of said mounting plate, with each of said hangers also being in close contact with said reinforcing member.

13. The roller skate utilizing wheels disposed generally in an in-line relationship as recited in claim 7 in which said expansion-producing means involves said second end of each axle having a tapered hole therein, with an inner portion of each such hole being threaded, and such threaded hole being disposed on the longitudinal centerline of the axle, said tightenable member being a screw having a tapered head, said tapered head being of a configuration generally matching the taper of said hole, the end of said screw opposite said tapered head having threads thereon, adapted to enter the end of said axle and operatively engage the threads of the inner portion of the threaded hole, said second end of said axle having longitudinal slots therein, permitting said tapered head of said screw, when said screw is tightened, to cause the end of said axle to enlarge, and thus retain the wheel on the axle.

14. The roller skate utilizing angularly mounted wheels disposed generally in an in-line relationship as recited in claim 7 in which said expansion-producing means involves said second end of said axle having a hole constituted by a relatively shallow outer portion connected to a relatively deep inner portion, said outer portion of said hole being tapered, and said inner portion of said hole being threaded, with said tapered outer portion and said inner threaded inner portion being disposed on the longitudinal centerline of said axle, said tightenable member being a screw having a tapered head, said tapered head of said screw being of a configuration generally matching the taper of said tapered outer hole portion, the end of said screw opposite said tapered head having threads thereon, adapted to enter the end of said axle and operatively engage the threads of said threaded inner hole portion, said second end of said axle having longitudinal slots therein, permitting said tapered head of said screw, when tightened, to cause the end of said axle to enlarge and to tightly engage a non-rotatable inner portion of the respective wheel, thus to retain the closely fitting wheel on the axle.

15. The roller skate utilizing angularly mounted wheels disposed generally in an in-line relationship as recited in claim 7 in which said mounting plate is of elongate construction having a pair of long sides, with a shoulder extending along each of said long sides, adjacent the mounting surface of said mounting plate and said wheel supporting hangers, a reinforcing member extending along the centerline of the mounting surface of said mounting plate, with each of said hangers being secured on said mounting surface in close contact with a respective shoulder as well as in close contact with said reinforcing member, thus to prevent any undesired twisting of a hanger when the skate is in use.

16. A roller skate utilizing wheels disposed generally in an in-line relationship, said skate comprising a mounting plate adapted to be secured to a boot or shoe, and having a mounting surface receiving a plurality of wheel supporting hangers affixed to such mounting plate in an essentially equally spaced relationship, said mounting plate being of elongate construction and having a pair of long sides, a shoulder extending along each of said long sides, in an adjacent relationship to said mounting surface and said hangers, against one or the other of which shoulders, each hanger is secured, a mounting hole in each of said hangers, a wheel-receiving axle to be mounted in the hole in each hanger, with each axle having first and second ends, a first end of each axle having attachment means enabling the axle to be mounted in the mounting hole in the respective hanger, a mid portion of each axle, intermediate said ends, receiving a closely fitting skate wheel thereon, which skate wheel includes the utilization of at least one ball bearing therein, which bearing has an inner race and an outer race, and said second end of each axle having expansion-producing means, said means including a tightenable member which, when tightened, will enlarge the diameter of the second end of the respective axle, thus forcing it into a tightly fitting relationship with the inner race of said ball bearing of the respective wheel, and therefore preventing the closely fitting wheel from coming off the end of the axle.

17. The roller skate utilizing wheels disposed generally in an in-line relationship as recited in claim 16 in which said expansion-producing means involves said second end of said axle having a hole constituted by a relatively shallow outer portion connected to a relatively deep inner portion, said outer portion of said hole being tapered, and said inner portion of said hole being threaded, with said tapered outer portion and said inner threaded inner portion being disposed on the longitudinal centerline of said axle, said tightenable member being a screw having a tapered head, said tapered head of said screw being of a configuration generally matching the taper of said tapered outer hole portion of the respective axle, the end of said screw opposite said tapered head having threads thereon, adapted to enter the end of said axle and operatively engage the threads of said threaded inner hole portion, said second end of said axle having longitudinal slots therein, permitting said tapered head of said screw, when said screw is tightened, to cause the end of said axle to enlarge, and thus retain the inner race of said ball bearing on the axle.

18. The roller skate utilizing wheels disposed generally in an in-line relationship as recited in claim 16 in which each of said wheel supporting hangers has a mounting hole disposed at an angle, so that the respective axle will be received therein at an angle to the mounting plate to which the hanger is affixed, the axle of each hanger residing at an angle to the base plate as a consequence of the angularly disposed hole resulting in the wheel mounted on the axle being disposed at an angle to the mounting plate.

19. The roller skate utilizing wheels disposed generally in an in-line relationship as recited in claim 18 in which said wheel supporting hangers are mounted on said mounting plate in an alternating array, with the axle operatively associated with one hanger being disposed at an angle with respect to the axle secured to the adjacent hanger, thus causing the wheels mounted on said axles to be disposed in a V-relationship, with the treads of such wheels being disposed in alignment.

20. The roller skate utilizing wheels disposed generally in an in-line relationship as recited in claim 16 in which said mounting plate is of elongate construction having a pair of long sides, with a shoulder extending along each of said long sides, adjacent the mounting surface of said mounting plate and said wheel supporting hangers, a reinforcing member extending along the centerline of the mounting surface of said mounting plate, with each of said hangers being secured on said mounting surface in close contact with a respective shoulder as well as in close contact with said reinforcing member, thus to prevent any undesired twisting of a hanger when the skate is in use.

21. A roller skate utilizing wheels disposed generally in an in-line relationship, said skate comprising a mounting plate adapted to be secured to the sole of a boot or shoe, with said mounting plate having a mounting surface receiving thereon a plurality of wheel supporting hangers, each hanger having a base portion to be affixed to said mounting surface and also having means for mounting an axle thereon, a wheel-receiving axle having first and second ends operatively associated with each hanger, with each said axle having a portion, intermediate said first and second ends, for receiving thereon a closely fitting skate wheel utilizing first and second ball bearings, with each ball bearing having an inner race and an outer race, said first end of each axle to be secured the respective hanger, with said second end of each axle having expansion producing means, said means including a tightenable member which, when tightened, will enlarge the diameter of said second end of the axle into forceful contact with the inner race of the second bearing, thus preventing rotation of said inner race of the second bearing thus to eliminate possible looseness, with said expansion producing means preventing the wheel from coming off the end of the axle.

* * * * *